US008016155B2

(12) United States Patent
Decker et al.

(10) Patent No.: US 8,016,155 B2
(45) **Date of Patent: *Sep. 13, 2011**

(54) DISPENSER CAPABLE OF DISPENSING SHEET-LIKE ARTICLES

(75) Inventors: Christopher Vincent Decker, Appleton, WI (US); Christopher Michael Bechyne, Appleton, WI (US); Stephen Robert Kehn, Appleton, WI (US); Cleary E. Mahaffey, Appleton, WI (US); Herb Flores Velazquez, Neenah, WI (US); John Martin Wydeven, Little Chute, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 14 days.

This patent is subject to a terminal disclaimer.

(21) Appl. No.: 11/821,305

(22) Filed: Jun. 22, 2007

(65) Prior Publication Data

US 2007/0246477 A1 Oct. 25, 2007

Related U.S. Application Data

(63) Continuation of application No. 10/810,130, filed on Mar. 26, 2004, now Pat. No. 7,275,658.

(51) Int. Cl.
*B65H 1/00* (2006.01)

(52) U.S. Cl. ..... 221/62; 221/34; 221/44; 221/45; 221/61; 221/63

(58) Field of Classification Search ..... 221/1–312 C
See application file for complete search history.

(56) References Cited

U.S. PATENT DOCUMENTS

| | | | | |
|---|---|---|---|---|
| 2,619,226 | A | | 11/1952 | Adams |
| D182,410 | S | | 4/1958 | Gemora |
| 3,780,908 | A | | 12/1973 | Fitzpatrick et al. |
| 3,819,043 | A | | 6/1974 | Harrison |
| 3,967,756 | A | | 7/1976 | Barish |
| 3,986,479 | A | * | 10/1976 | Bonk ..... 118/506 |
| D244,583 | S | | 6/1977 | Barish |
| 4,096,986 | A | | 6/1978 | Florian |
| 4,138,034 | A | | 2/1979 | McCarthy |
| 4,328,917 | A | | 5/1982 | Reeberg |
| 4,462,507 | A | * | 7/1984 | Margulies ..... 221/63 |
| 4,469,243 | A | * | 9/1984 | Ito et al. ..... 221/34 |
| 4,487,328 | A | | 12/1984 | Wilcox et al. |
| 4,526,291 | A | | 7/1985 | Margulies |

(Continued)

FOREIGN PATENT DOCUMENTS

CA 2013794 A1 10/1990

(Continued)

*Primary Examiner* — Michael K Collins
(74) *Attorney, Agent, or Firm* — R. Joseph Foster, III

(57) ABSTRACT

A dispenser is disclosed which is capable of dispensing articles from two locations. The dispenser includes first and second members pivotally connected together by a first hinge to form a first entrance into the dispenser. The first and second members are capable of housing a plurality of wet or dry, sheet-like articles. The first entrance provides reach-in access wherein multiple sheet-like articles can be withdrawn at one time. The second member also has a second entrance formed therein from which the sheet-like articles can be individually withdrawn. The dispenser further includes a third member secured to the first member by a hinge that is coaxially aligned with the first hinge. The third member is capable of pivoting on its hinge to cover the second entrance.

18 Claims, 5 Drawing Sheets

U.S. PATENT DOCUMENTS 4,570,820 A 2/1986 Murphy
4,735,317 A 4/1988 Sussman et al.
4,739,900 A 4/1988 Borst
D295,830 S 5/1988 Holly
D295,961 S 5/1988 Holly
4,854,473 A 8/1989 Dubach
4,865,221 A 9/1989 Jackson et al.
D311,334 S 10/1990 Flynn et al.
4,964,526 A * 10/1990 Stephens ..... 220/520
5,037,000 A 8/1991 Selame
5,040,680 A 8/1991 Wilson et al.
5,076,465 A 12/1991 Lawson
D330,913 S 11/1992 Hiromori
D365,755 S 1/1996 Kanfer et al.
D367,609 S 3/1996 Frank et al.
5,540,332 A 7/1996 Kopacz et al.
5,540,354 A 7/1996 Annand
5,542,567 A * 8/1996 Julius ..... 221/63
D374,774 S 10/1996 Cassel
5,573,132 A * 11/1996 Kanfer et al. ..... 220/4.23
5,638,957 A 6/1997 Brasier
5,647,506 A 7/1997 Julius
5,699,912 A 12/1997 Ishikawa et al.
5,699,925 A * 12/1997 Petruzzi ..... 220/4.27
5,735,087 A 4/1998 Olden
5,810,200 A 9/1998 Trokhan
6,019,510 A 2/2000 Gonzalez et al.
6,092,690 A * 7/2000 Bitowft et al. ..... 220/831
6,102,247 A 8/2000 Crawford
6,158,614 A 12/2000 Haines et al.
6,206,221 B1 3/2001 Bando et al.
6,213,300 B1 4/2001 Flaig et al.
D443,450 S 6/2001 Ruhotas et al.
6,250,495 B1 6/2001 Bando
D450,960 S * 11/2001 Boyea et al. ..... D6/515
8,364,101 4/2002 Schultz
6,394,298 B1 * 5/2002 Zaidman ..... 220/259.1
6,419,114 B1 7/2002 Lenz et al.
D461,403 S 8/2002 Chomik et al.
D465,685 S 11/2002 Dellerman et al.
6,523,690 B1 2/2003 Buck et al.
D473,740 S 4/2003 Ruhotas et al.
6,550,634 B1 4/2003 Alegre De Miquel et al.
6,609,616 B2 8/2003 Dilnik et al.
6,729,498 B2 * 5/2004 Yelton et al. ..... 221/63
6,758,369 B2 7/2004 Morin et al.
6,910,579 B2 * 6/2005 Reinke et al. ..... 206/494
6,964,726 B2 11/2005 Chen et al.
7,028,840 B2 * 4/2006 Huang et al. ..... 206/494
7,243,816 B2 * 7/2007 Aochi ..... 220/829
7,275,658 B2 * 10/2007 Decker et al. ..... 221/61
2002/0192433 A1 12/2002 Huang at al.
2003/0010789 A1 1/2003 Sosalla et al.
2004/0115393 A1 6/2004 Vogel et al.
2005/0211716 A1 9/2005 Decker et al.
2005/0211717 A1 9/2005 Decker et al.
2005/0211718 A1 9/2005 Decker et al.
2005/0236416 A1 * 10/2005 Reinke et al. ..... 221/63

FOREIGN PATENT DOCUMENTS

CA 2195211 A1 11/1996
CA 2329789 A1 11/1999
CA 2351853 A1 6/2000
CA 2377683 A1 1/2001
CA 2349604 A1 3/2001
CA 2189431 C 10/2001
CA 2218649 C 12/2002
EP 0 697 344 A1 2/1996
EP 0 738 667 B1 7/1999
EP 1 129 656 A1 9/2001
EP 0 968 934 B1 2/2003
EP 1 131 257 B1 4/2003
WO WO 97/39964 A1 10/1997
WO WO 99/29602 A1 6/1999
WO WO 99/55213 A1 11/1999
WO WO 01/83324 A1 11/2001
WO WO 03/002416 1/2003

* cited by examiner

DISPENSER CAPABLE OF DISPENSING SHEET-LIKE ARTICLES

This application claims priority as a continuation of application Ser. No. 10/810,130, filed on Mar. 26, 2004 now U.S. Pat. No. 7,275,658. The entirety of application Ser. No. 10/810,130 is incorporated herein by reference.

BACKGROUND OF THE INVENTION

Sheet-like articles are available in a variety of shapes, sizes and compositions and can be either wet or dry. One common wet article is referred to as a "wet wipe" which is a pre-moistened, disposable towelette. Such wet wipes can be utilized in a variety of applications both domestic and industrial and can perform a variety of functions. Wet wipes are typically used to wipe surfaces both animate and inanimate, and may provide numerous benefits such as cleaning, cleansing, disinfecting, and skin care benefits. A common dry article is a tissue used by a human to blow his or her nose. One commercially available tissue is sold under the name KLEENEX®, which is a registered trademark of Kimberly-Clark Corporation, having an office at 401 North Lake Street, Neenah, Wis. 54956.

One particular application of sheet-like, pre-moistened articles or wipes is for wiping parts of a human body particularly when wash water is not available, for example when traveling. Wipes are also commonly used for human cleansing and wiping in general such as anal, perineal and genital cleansing, and face and hand cleansing. One example of such a wipe is an intimate feminine hygiene wipe. Wipes may also be used for application of substances to the body including removing or applying make-up, skin conditioners and medications. Another application of wipes is during diaper changes and also for the treatment of adult and baby dermatitis partly caused by the use of diapers and incontinence undergarments. In addition, wipes are also applicable for wiping and or cleaning other surfaces or for the application of compositions to surfaces, for example, kitchen and bathroom surfaces, eyeglasses, shoes and surfaces which require cleaning in industry. Examples of industrial applications include cleaning surfaces of tools, machinery, contaminated, dirty or greasy parts and materials, etc. Wipes can also be used for the cleaning or grooming of household pets, like cats and dogs.

Various dispenser designs are commercially available today for housing, storing and dispensing such sheet-like articles. Some are large tubs or flexible packages that are several inches in vertical height that are designed to hold over eighty articles while other designs include slim travel packs that can contain less than twenty-five articles. Some dispensers allow for removal of an individual sheet or wipe while others permit multiple sheet-like articles or wipes to be simultaneously withdrawn from the dispenser. One issue with many dispensers is the lack of ease in removing a single sheet-like article with one hand. For example, a mother in the act of changing an infant's diaper may be required to use her right hand to hold the baby still while using only her left hand to open and grab a wet wipe. The wet wipe is then used to wipe the buttock of the baby before a clean diaper is placed on the baby. Another issue that sometimes arises is that the user needs to remove several wipes from the dispenser at a single time. In this case, it is not efficient to remove the wipes one at a time. Therefore, there is a need for a dispenser that is capable of dispensing articles in a pop-up mode as well as in a reach-in mode.

Now a dispenser has been invented that can dispense articles either one at a time in a pop-up mode or provide reach-in access wherein several articles can be simultaneously withdrawn.

SUMMARY OF THE INVENTION

Briefly, this invention relates to a dispenser capable of dispensing articles from two locations. The dispenser includes first and second members pivotally connected together by a first hinge to create a first entrance into the dispenser. The first and second members are capable of housing a plurality of wet or dry, sheet-like articles. The first entrance provides reach-in access wherein multiple sheet-like articles can be withdrawn at one time. The second member also has a second entrance formed therein from which the sheet-like articles can be individually withdrawn in a pop-up mode. The dispenser further includes a third member secured to the first member by a hinge that is coaxially aligned with the first hinge. The third member is capable of pivoting on its hinge to cover the second entrance.

DETAILED DESCRIPTION

Referring to FIGS. 1 and 5-8, a dispenser 10 is shown which is capable of housing, storing and dispensing a plurality of dry or wet sheet-like articles 12 from two locations. The dispenser 10 has a generally rectangular configuration with a longitudinal central axis X-X and a transverse central axis Y-Y, see FIG. 1, and a vertical axis Z-Z, see FIG. 8. The dispenser 10 also has an overall length l and an inside width w, see FIG. 1, and a height h, see FIG. 8. The dimensions of the dispenser 10 can vary to suit one's particular needs. The overall size of the dispenser 10 can be selected so as to be slim enough to easily fit into a woman's purse, into a diaper bag, into a glove compartment of a car, into a desk drawer, etc. The dispenser 10 may also fit into the enlarged pocket of an overcoat. The dispenser 10 is reusable and is capable of being refilled multiple times during its life. For the travel pack dispenser, as shown, the dimensions can range from between about 6 inches (about 15 centimeters (cm)) to about 12 inches (about 30 cm) in overall length L, from between about 3 inches (about 7.6 cm) to about 6 inches (about 15 cm) in inside width W, and from between about 0.25 inches (about 0.6 cm) to about 3.5 inches (about 9 cm) in height h. More desirably, the dispenser 10 can range from between about 7 inches (about 18 cm) to about 10 inches (about 25 cm) in overall length L, from between about 3.5 inches (about 8.9 cm) to about 5 inches (about 12.7 cm) in inside width W, and from between about 0.5 inches (about 1.2 cm) to about 3 inches (about 7.6 cm) in height h. Most desirably, the dispenser 10 will have a height h of about 1 inch (about 2.5 cm).

The dispenser 10 is designed to house and store a plurality of the sheet-like articles 12 in a water resistance environment. For a dry sheet-like article, such as a dry facial tissue, the dispenser 10 will retain the articles 12 in a dry state and prevent moisture or liquid from contacting them. For a wet sheet-like article, such as a wet wipe, the dispenser 10 will allow the articles 12 to retain their moisture until the user is ready to withdraw and use the wet wipe. The wet or dry sheet-like articles 12 can be removed from the dispenser 10 either individually or as a group of two or more.

Figure 2:
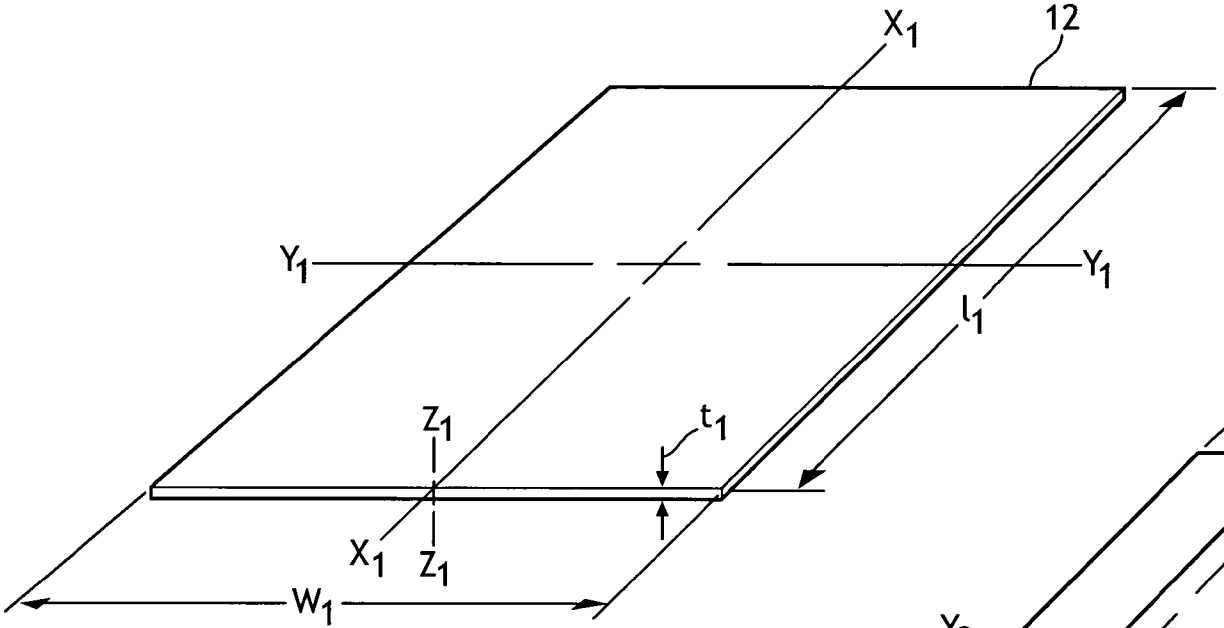
FIG. 2 is a perspective view of a sheet-like article which can be housed in the dispenser shown in FIG. 1.

Referring to FIG. 2, a sheet like article 12 is shown having a longitudinal central axis $X_1$-$X_1$, a transverse central axis $Y_1$-$Y_1$, and a vertical axis $Z_1$-$Z_1$. By "sheet-like articles" it is meant relatively flat sheets that can be wet or dry to the touch and can include wet wipes, dry wipes, pre-moistened wipes, dry tissue, dry facial tissue, pre-moistened facial tissues, wet or dry towelettes, impregnated sheets, wet or dry towels, etc. Each sheet-like article 12 can have any desired geometrical cross-sectional configuration. Desirably, the sheet-like article 12 has either a square or rectangular cross-sectional shape. The sheet-like article 12 has a length $l_1$, a width $w_1$ and a thickness $t_1$. The length $l_1$ and width $w_1$ dimensions can vary depending upon one's needs and desires. In various embodiments, the thickness $t_1$ dimension can be between about 0.4 (mm) to about 5 mm. Desirably, each sheet-like article 12 has a thickness $t_1$ that ranges from between about 0.5 mm to about 3.5 mm. More desirably, each sheet-like article 12 has a thickness $t_1$ that ranges from between about 0.6 mm to about 3 mm. For example, one commercially available sheet-like article has a length $l_1$ of about 7.5 inches (about 19 cm), a width $w_1$ of about 7.5 inches (about 19 cm) and a thickness $t_1$ of less than about 1 mm, when it is in a non-folded state.

Figure 3:
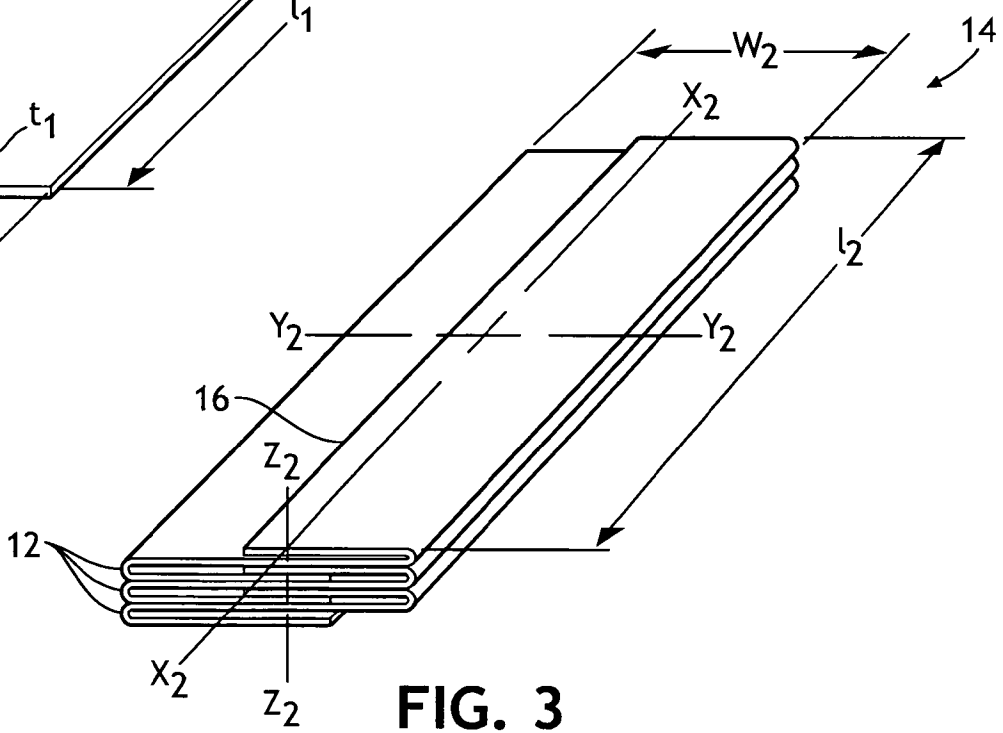
FIG. 3 is a perspective view of a stack of interleaved sheet-like articles which are Z-folded and which can be housed in the dispenser shown in FIG. 1.

Referring now to FIG. 3, a plurality of the sheet-like articles 12 are shown arranged in a stack 14. By "stack" it is meant a quantity, a pile, an arrangement or group of three or more articles. Each stack 14 can include an orderly arrangement and can include up to 80 or more sheet-like articles12. Desirably, each stack 14 will contain from about 8 to about 50 sheet-like articles 12. More desirably, each stack 14 will contain from about 8 to about 40 sheet like articles 12. Most desirably, each stack 14 will contain about 16 sheet-like articles 12. In FIG. 3, a plurality of Z-folded and interleaved sheet-like articles 12 are depicted forming the stack 14. The stack 14 has a longitudinal central axis $X_2$-$X_2$, a transverse central axis $Y_2$-$Y_2$, and a vertical axis $Z_2$-$Z_2$. In the stack 14, each of the sheet-like articles 12 is Z-folded to a reduced width $w_2$, with the width $w_2$ being less than the initial unfolded width $w_1$, see FIG. 1. Desirably, the width $w_2$ of the folded sheet-like article 12 will range from between about 1 inch (about 2.5 cm) to about 5 inches (about 12.7 cm). More desirably, the width $w_3$ of the folded sheet-like article 12 will range from between about 2 inches (about 5 cm) to about 4 inches (about 10 cm). More desirably, the width $w_2$ of the folded sheet-like article 12 will be about 3.75 inches (about 9.5 cm).

Each of the sheet-like articles 12 also has a length $l_2$, which in FIG. 3, is equal to the length $l_1$. However, the sheet-like articles 12 can be folded lengthwise as well, if desired. Each of the sheet-like articles 12 has an upper edge 16 that can be easily grabbed or snatched. The upper edge 16 can be located on either side of the longitudinal central axis $X_2$-$X_2$. It is also advantageous that the upper edge 16 be visibly apparent. Each of the sheet-like articles 12 in the stack 14 is interleaved or sandwiched between a portion of an adjacent sheet-like article 12 such that as the upper most article 12 is removed from the stack 14, the subsequent sheet-like article 12 will be exposed and have its upper edge 16 available to be grabbed or snatched.

Figure 4:
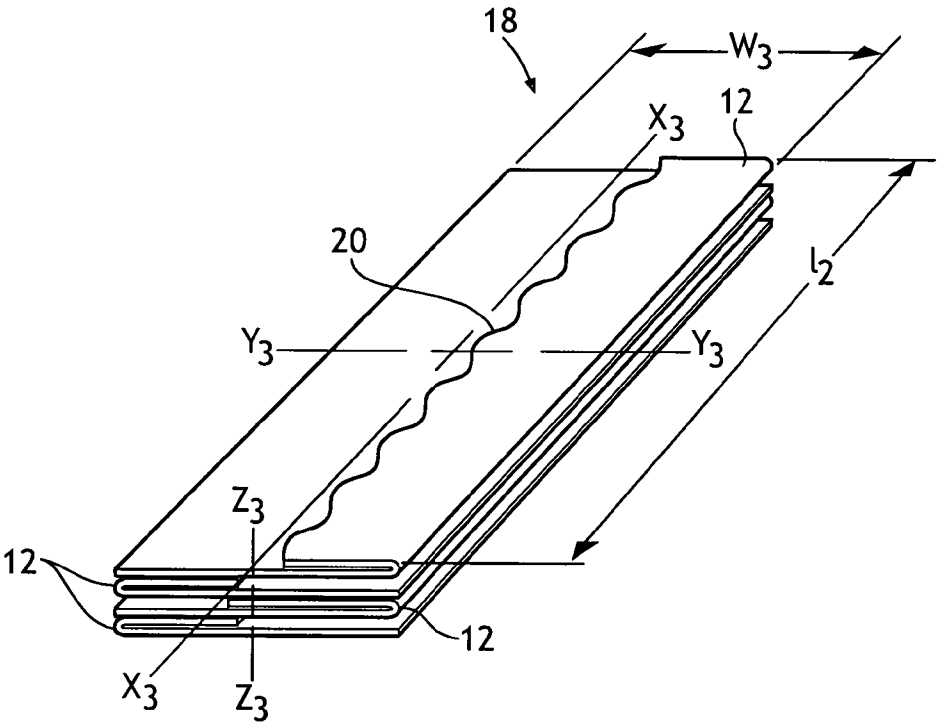
FIG. 4 is a perspective view of a stack of non-interleaved sheet-like articles which are J-folded and which can be housed in the dispenser shown in FIG. 1.

Referring now to FIG. 4, a plurality of sheet-like articles 12 are depicted which are arranged into a stack 18. In the stack 18, the sheet-like articles 12 are J-folded but are not interleaved together. Each of the sheet-like articles 12 has an upper edge 20 which contains a scallop design. The scallop edge 20 consists of a series of semicircular curved projections forming an ornamental border. The scallop design makes the upper edge 20 more visible to the ultimate consumer and the scallop design can also aid in allowing the user to grab the sheet-like article 12. The stack 18 also includes an orderly arrangement of the sheet-like articles 12, as was explained above with reference to the stack 14. The number of sheet-like articles 12 making up the stack 18 can also be of the quantity recited above. The stack 18 also has a longitudinal central axis $X_3$-$X_3$, a transverse central axis $Y_3$-$Y_3$, and a vertical axis $Z_3$-$Z_3$. In the stack 18, each of the sheet-like articles 12 are folded to a reduced width $w_3$, with the width $w_3$ being less than the initial unfolded width $w_1$, see FIG. 1. Desirably, the width $w_3$ of the folded sheet-like article 12 will range from between about 1 inch (about 2.5 cm) to about 5 inches (about 12.7 cm). More desirably, the width $w_3$ of the folded sheet-like article 12 will range from between about 2 inches (about 5 cm) to about 4 inches (about 10 cm). Most desirably, the width $w_3$ of the folded sheet-like article 12 will be about 3.75 inches (about 9.5 cm). Each of the sheet-like articles 12 also has a length $l_3$ which, in FIG. 4, is equal to the length $l_1$. However, as explained above, the sheet-like articles 12 can be folded lengthwise, if desired. As with the stack 14, the upper edge 20 of each of the sheet-like articles 12 making up the stack 18, can each be easily grabbed or snatched.

It should be noted that the sheet-like articles 12 can be absorbent or non-absorbent. By "absorbent" it is meant that the sheet-like articles 12 are capable of absorbing a liquid, a chemical solution, a non-solid substance, etc. An example of a liquid is water, an example of a chemical solution is mouthwash, and an example of a non-solid substance is a makeup cream. The sheet-like articles 12 can be oriented in the dispenser 10 in a relatively flat arrangement or be folded in some fashion. The longitudinal axis $X_2$-$X_2$ or $X_3$-$X_3$ of the folded sheet-like articles 12 should be aligned essentially parallel to the longitudinal axis X-X of the dispenser 10, see FIG. 1. This orientation will facilitate removal of the sheet-like articles 12 from the dispenser 10. Common ways to fold the sheet-like articles 12 include, but are not limited to, C-folds, J-folds, Z-folds, etc.

The sheet-like articles 12 can be formed from synthetic or natural fibers or a combination of such fibers. Cotton and wood pulp fibers are two examples of natural fibers. Synthetic fibers can include polyolefin fibers, such as polypropylene and polyethylene fibers. The sheet-like articles 12 can be moistened with an aqueous composition which contains amongst others things, surfactants, preservatives, lotions, solutions, oils, medication, scents, fragrances, etc. or any combination thereof. One example of a baby wet wipe is HUGGIES ORIGINAL® which is a registered trademark of Kimberly-Clark Corporation having an office at 401 North Lake Street Neenah, Wis. 54956. This wet wipe contains water, potassium laureth phosphate, glycerin, polysorbate 20, tetrasodium EDTA, DMDM hydantoin, methylparaben, malic acid and a fragrance. The sheet-like articles 12 are typically packaged in the dispenser 10 to facilitate easy storage, transport and retrieval of the articles 12 for various uses.

The dispenser 10 is unique in that it allows the sheet-like articles 12 to be removed or withdrawn either individually or as a group of two or more articles. One or more of the sheet-like articles 12 can be removed through a first entrance by reaching into the dispenser 10 or an individual sheet-like article 12 can be withdrawn through a second entrance in a pop-up fashion. The dispenser 10 can be manufactured in various sizes and shapes and can be constructed from a variety of materials. The dispenser 10 can be constructed from a relatively rigid or semi-rigid material. By "rigid or semi-rigid" material it is meant a material that will maintain its overall shape and will not substantially deform when normally handled for its intended purpose. A "rigid or semi-rigid" material is commonly greater than 0.5 millimeters (mm) in thickness and can be formed from almost any type of material. A desirable material from which the dispenser 10 can be formed is a thermoplastic material. The thermoplastic can be a polyolefin such as polypropylene, polyethylene, or a copolymer formed therefrom. Other kinds of thermoplastics can also be used. The dispenser 10 can also be formed from ferrous and nonferrous metals, metal alloys, aluminum, wood, plywood, wood veneer, thick cardboard, a laminate of different kinds of plastics, a combination of plastic and paper laminates, plastic film laminates, thermoplastic strands inserted into a laminate, or a combination thereof. In addition, other kinds of rigid or semi-rigid materials known to those skilled in the art can also be used.

It should be noted that very flexible materials having a thickness of less than about 0.4 mm are not interpreted as being a "rigid or semi-rigid" material. Flexible wrapping material such as aluminum foil, thin plastic films, very thin laminates, paper bags, etc. are not considered to be rigid or semi-rigid materials.

Desirably, the dispenser 10 is formed from a thermoplastic material that can be injection molded. Normally, the injection molded material will have a thickness ranging from between about 0.5 mm to about 6 mm. More desirably, the injection molded material will have a thickness ranging from between about 0.6 mm to about 5 mm. Most desirably, the injection molded material will have a thickness ranging from between about 0.75 mm to about 2 mm.

Referring now to FIGS. 1 and 5-9, the dispenser 10 includes a first member 22 and a second member 24. The first and second member, 22 and 24 respectively, are hollow members having a depth dimension and each having an open surface or wall. Each of the first and second members, 22 and 24 respectively, are capable of holding or retaining a quantity of the sheet-like articles 12. The first and second members, 22 and 24 respectively, are pivotally connected by a first hinge 26. The first hinge 26 is shown as being bifurcated into two distinct, spaced apart parts. The two parts of the first hinge 26 are coaxially aligned with one another. The first and second members 22 and 24 can be formed by injection molding. By injection molding the first and second members, 22 and 24 respectively, together, they can be integrally formed as a single entity. The first hinge 26 can also be injection molded along with the first and second members, 22 and 24 respectively. The first hinge 26 can be a living hinge. By a "living hinge" it is meant a hinge that is integrally formed with and constructed from the same material as was used to form the first and second members, 22 and 24 respectively. Usually, a living hinge has a smaller thickness relative to the overall thickness of the two members to which it is connected.

Figures 5, 6, 7, 8:
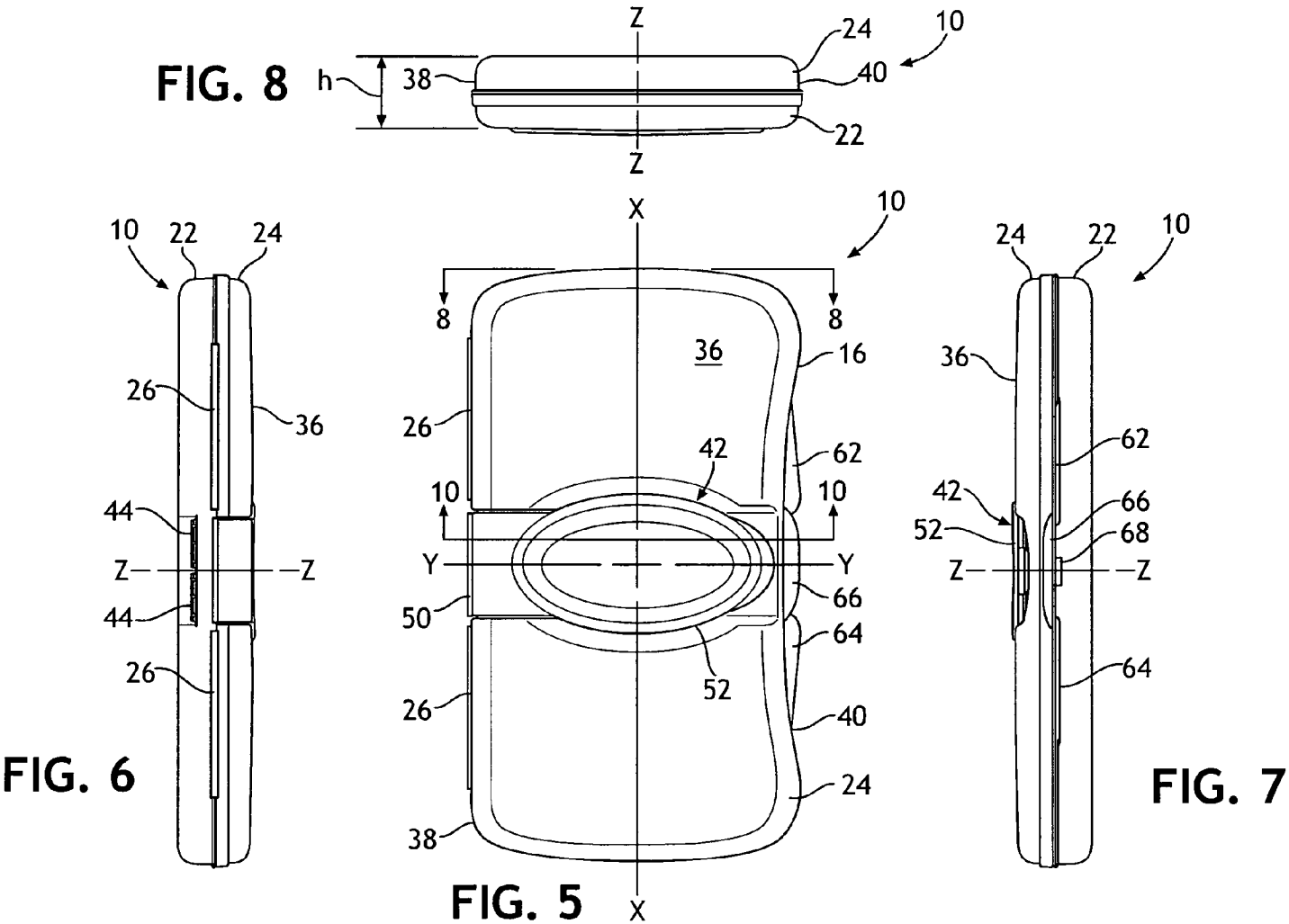
FIG. 5 is a top view of the dispenser shown in FIG. 1 when the second member is in a closed position and a third member is secured over the aperture.
FIG. 6 is a left side view of the dispenser shown in FIG. 5.
FIG. 7 is a right side view of the dispenser shown in FIG. 5.
FIG. 8 is an end view of the dispenser shown in FIG. 5 taken along the line 8-8.

As shown in FIG. 8, the dispenser 10 is depicted as a slim travel pack that can be initially filled with a plurality of sheet-like articles 12. The dispenser 10 has a height "h" which can range from between about 0.25 inches (about 0.6 centimeters) to about 3.5 inches (about 9 centimeters). Desirably, the height "h" of the dispenser 10 ranges from between about 0.5 inches (about 1.3 centimeters) to about 2 inches (about 5 centimeters). More desirably, the dispenser 10 has a height "h" of about 1 inch (about 2.5 centimeters). As explained above, the sheet-like articles 12 can be stacked in the dispenser 10 in an interleaved or non-interleaved array. In either case, the upper edge 16 or 20 of each sheet-like article 12 should extend lengthwise along the longitudinal central axis X-X of the dispenser 10.

Figure 10:
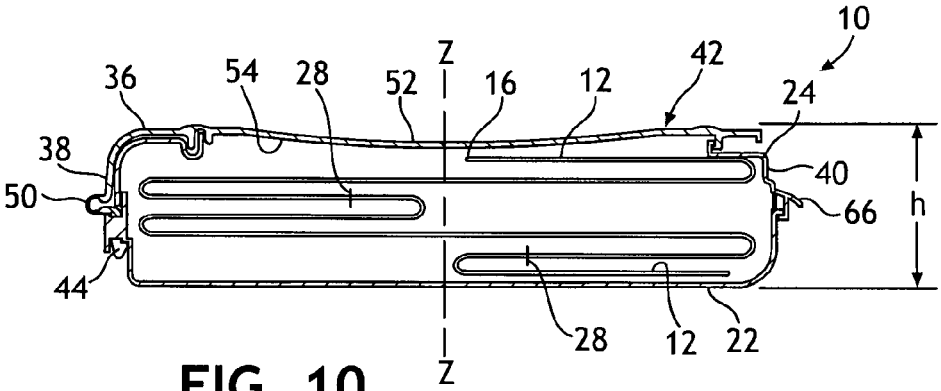
FIG. 10 is a cross-sectional view of the dispenser shown in FIG. 5 taken along line 10-10 and depicting a plurality of sheet-like articles stacked together and Z-folded with each sheet-like article being joined to an adjacent sheet-like article by a tear line.

Referring now to FIG. 10, one will notice that each of the sheet-like articles 12 is temporarily connected or joined to an adjacent sheet-like article 12 by a tear line 28. The tear line 28 can be a perforation line, a score line, a series of holes punched in the material, a necked or reduced area of thickness, a zone of weakness, etc. that is easily broken as one pulls on the uppermost sheet-like article 12. The sheet-like articles 12 can also be connected to one another by an adhesive. For example, a clip of eight sheet-like articles 12 can be adhesively connected to a second clip of sheet-like articles 12 by a continuous or non-continuous line of adhesive. By so joining adjacent sheet-like articles 12, one can be assured that a subsequent sheet-like article 12 will follow the preceding sheet-like article 12 toward the exit opening formed in the dispenser 10. The tear line 28 is designed to break or sever as the upper most sheet-like article 12 is almost completely withdrawn from the dispenser 10. Once the tear line 28 breaks, the upper most sheet-like article 12 will be completely severed from the next adjacent sheet-like article 12.

One will also notice from FIG. 10, that when the sheet-like articles 12 are temporarily connected or joined to one another, such as by the tear line 28, that it is possible to fold the sheet-like articles 12 in various ways. This means that each sheet-like article 12 does not have to be folded exactly the same way as an adjacent sheet-like article 12 is folded. In FIG. 10, the uppermost sheet-like article 12 is Z-folded in a first direction and the subsequent sheet-like article 12 is Z-folded in an opposite direction. Various folding configurations can be utilized which may increase the number of sheet-like articles 12 that can be housed in the dispenser 10 at one time.

Figure 1:
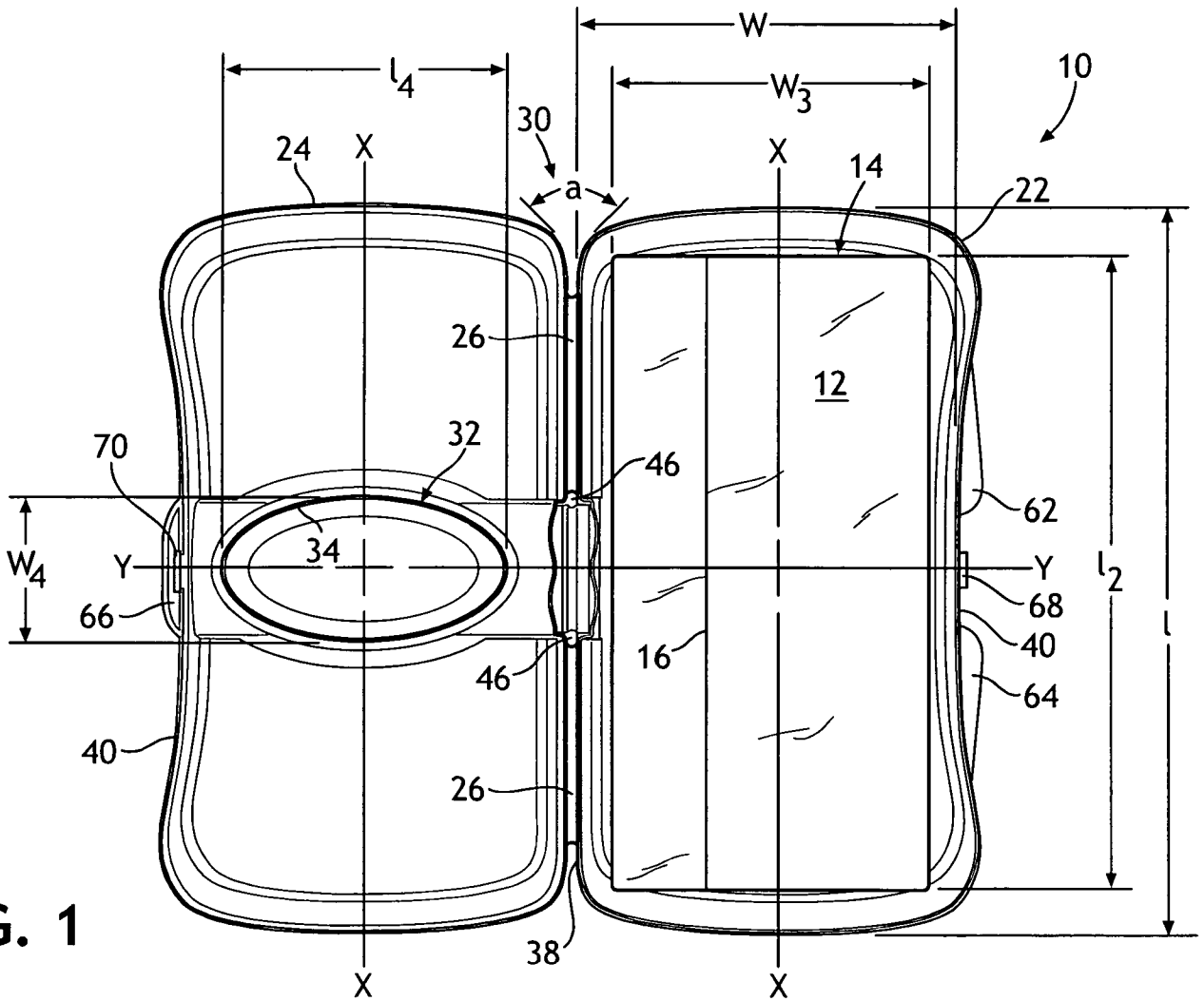
FIG. 1 is a top view of a dispenser showing the first and second members in an open position revealing the interior of the dispenser.

Referring again to FIGS. 1-9, the first and second members, 22 and 24 respectively, are hinged together and can pivot or rotate between a close position and an open position, relative to one another. In FIG. 1, the second member 24 is shown pivoted on the first hinge 26 and rotated counter clockwise to an open position thereby forming a first entrance 30 into the dispenser 10. When the second member 24 is so pivoted and the angle $\alpha$ is at least 90 degrees relative to the first member 22, the first entrance 30 will be equal to or larger than the entire upper surface of the exposed sheet-like article 12. The length $l_2$ and the width $w_2$ of the stack 14 of the sheet-like articles 12 are less than the overall length l and the inside width w of the dispenser 10. This size difference is important for it permits the user to easily reach-in with his or her hand and grab or snatch as many of the sheet-like articles 12 as he or she wishes. It should be readily apparent to the reader that the first entrance 30 allows for one or more of the sheet-like articles 12 to be removed or withdrawn at a single time. In fact, the entire stack 14 of the sheet-like articles 12 could be withdrawn by the user at one time, if desired.

Still referring to FIGS. 1-9, the second member 24 of the dispenser 10 also has a second entrance 32 formed therein. The second entrance 32 is shown as an aperture 34 formed completely through a top wall 36 of the second member 24. Desirably, the top wall 36 is a planar surface which is vertically oriented relative to the upper surface of the stack 14 of the sheet-like articles 12. The second entrance 32 has a surface area of at least about 20 $cm^2$. Desirably, the second entrance 32 has a surface area of at least about 25 $cm^2$. The second entrance 32 is depicted as being aligned along both the longitudinal and transverse axes, X-X and Y-Y respectively, of the dispenser 10. In fact, the intersection of the longitudinal and transverse axes, X-X and Y-Y respectively, forms the center of the second entrance 32 or the aperture 34. It should be noted that the second entrance 32 can be offset from the longitudinal and transverse axes, X-X and Y-Y respectively, if desired. The second entrance 32 is shown being elliptical or oval in configuration, although other geometrical configurations could also be used. The elliptical or oval shaped second entrance 32 has a length $l_4$ measured along its major axis and a width $w_4$ measured along its minor axis. The major axis or length $l_4$ of the second entrance 32 should to be aligned approximately parallel to the transverse axis Y-Y of the dispenser 10 and the minor axis or width $w_4$ of the second entrance 32 should be aligned approximately parallel to the longitudinal axis X-X of the dispenser 10.

The dimensions of the second entrance 32 or the aperture 34 are also important to ensure that the second entrance 32 of the dispenser 10 functions properly. The second entrance 32 should have a transverse dimension or length $l_4$ that is at least about 65% of the inside width w of the dispenser 10. For example, if the inside width w if the dispenser is 10.5 cm, then the transverse dimension of the second entrance 32 should be at least about 6.8 cm. Another way of describing the length $l_4$ of the major axis of the second entrance 32 is to compare it to the width $w_3$ of the folded sheet-like articles 12. Desirably, the second entrance 32 has a length $l_4$ which ranges from between about 60% to 150% of the width $w_3$ of the folded sheet-like articles 12. More desirably, the second entrance 32 has a length $l_4$ which ranges from between about 70% to 100% of the width $w_3$ of the folded sheet-like articles 12. Most desirably, the second entrance 32 has a length $l_4$ which ranges from between about 75% to 95% of the width $w_3$ of the folded sheet-like articles 12. For example, if the folded sheet-like articles 12 have a width of about 3.5 inches (about 8.9 cm), then the second entrance 32 or the aperture 34 should have a length $l_4$ or at least about 2.1 inches (about 5.3 cm).

In addition, the second entrance 32 or the aperture 34 must have a width $w_4$ which is at least about 0.75 inches (about 1.9 cm) in order to accommodate the width of a user's thumb and index finger. Desirably, the second entrance 32 has a width $w_4$ which ranges from between about 0.75 inches (about 1.9 cm) to about 3.5 inches (about 9 cm). More desirably, the second entrance 32 has a width $w_4$ which ranges from between about 1 inch (about 2.5 cm) to about 2.5 inches (about 6.3 cm). Most desirably, the second entrance 32 has a width $w_4$ which ranges from between about 1 inch (about 2.5 cm) to about 2 inches (about 5 cm).

Referring again to FIGS. 1, 5 and 8-11, the dispenser 10 also has a first longitudinal edge 38 spaced apart from and oppositely aligned to a second longitudinal edge 40. The first and second longitudinal edges, 38 and 40 respectively, are aligned approximately parallel to the longitudinal central axis X-X of the dispenser 10. The first hinge 26 is located along or adjacent to the first longitudinal edge 38. As the first member 22 pivots on the first hinge 26 it will rotate away from the second member 24, and cause the first entrance 30 into the dispenser 10 to open. The first and second members 22 and 24 can pivot on the hinge 26, relative to the first longitudinal edge 38, and move away from the second longitudinal edge 40 to open the first entrance 30.

Figure 9:
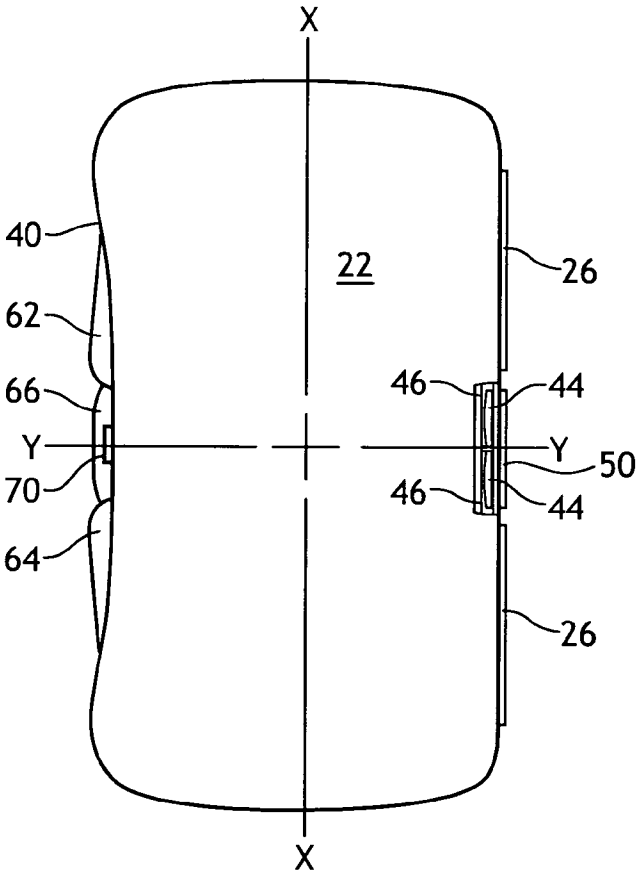
FIG. 9 is a bottom of the dispenser shown in FIG. 5.
Figure 11:
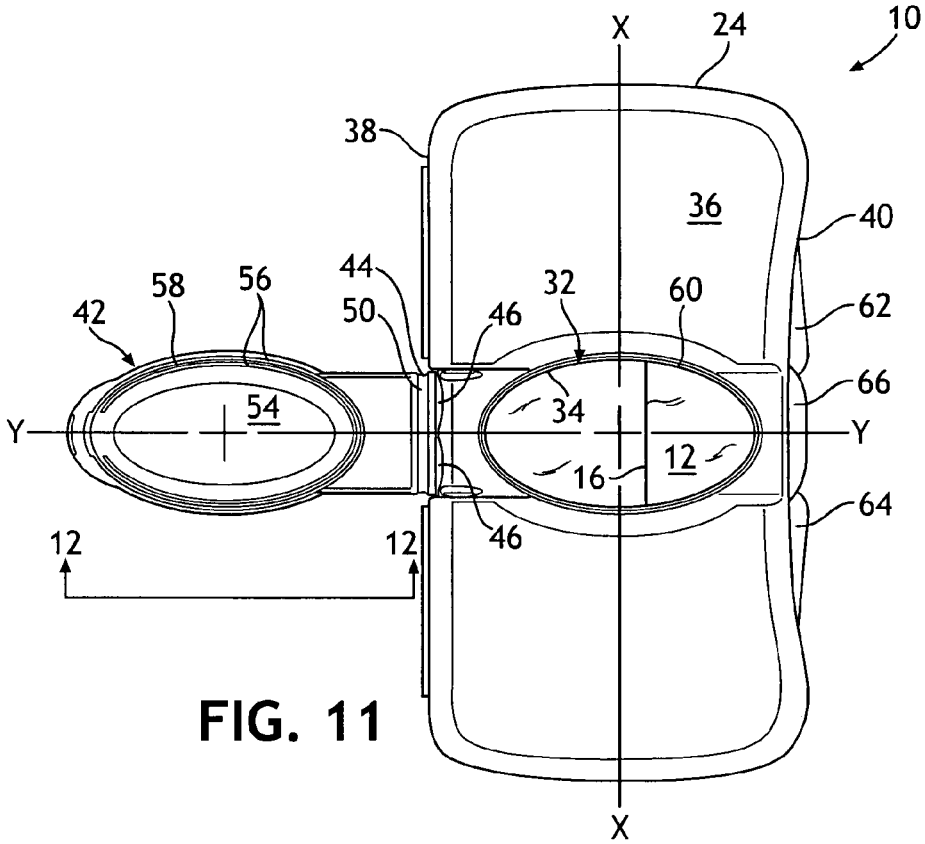
FIG. 11 is a top view of the dispenser shown in FIG. 5 with the third member being pivotally moved to an open position.

Referring now to FIGS. 1 and 5-12, the dispenser 10 further includes a third member 42 which is secured to the first member 22. The third member 42 can be integrally formed with or be joined to the first member 22. Various ways to connect the two members 22 and 42 include heat staking, sonic bonding, ultrasonic bonding, chemical bonding, adhesively joining or by a mechanical connection. One type of mechanical connection can be obtained by forming one or more tabs or tongues 44 on an end of the third member 42 and inserting the tabs or tongues 44 into a corresponding number of openings 46 formed in the first member 22. FIGS. 1 and 9 show the presence of a pair of openings 46 formed in the first member 22. In FIGS. 10 and 11, one can clearly see two tabs or tongues 44 inserted into the pair of openings 46. Each tab or tongue 44 can contain a hook mechanism 48 which will lock into the pair of openings 46 so as to permanently secure the third member 42 to the first member 22.

Still referring to FIG. 5, the third member 42 also has a second hinge 50 coaxially aligned with the first hinge 26. The second hinge 50 is aligned along the first longitudinal edge 38 and is located between the bifurcated two parts of the first hinge 26. The third member 42 is capable of pivoting on the second hinge 50 to cover said second entrance 32. By coaxially aligning the first and second hinges, 26 and 50 respectively, it is possible to open the first and second entrances, 30 and 32 respectively, at the same time. The coaxial alignment of the first and second hinges, 26 and 50 respectively, also permits the first entrance 30 to be opened while the second entrance 32 remains closed.

In FIG. 5, the third member 42 is depicted in a closed position wherein it completely covers the second entrance 32. In FIG. 11, the third member 42 is shown pivoted or rotated back away from the second entrance 32 or aperture 34 through an angle of more than 90 degrees to a position wherein the second entrance 32 is completely open. In this orientation, the user can easily insert his or her thumb and index finger into the second entrance 32 or aperture 34 and grab the upper edge 16 of the sheet-like article 12. The uppermost sheet-like article 12 can then be individually withdrawn through the second entrance 32 or aperture 34 and be removed from the dispenser 10.

Figure 12:
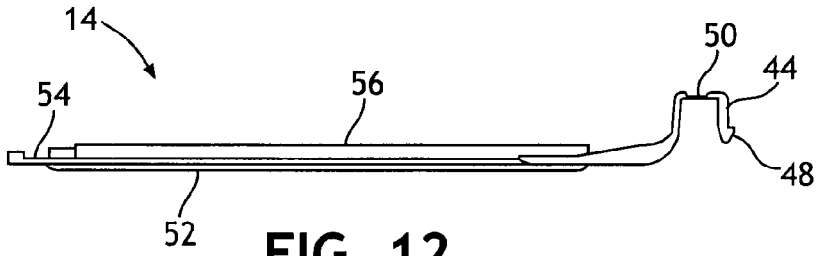
FIG. 12 is a side view of the third member shown in FIG. 11 taken along line 12-12.

Referring to FIGS. 1, 11 and 12, the third member 42 can be of almost any geometrical configuration but is depicted as having an elliptical or oval shape so as to conveniently nest over the aperture 34. The top wall 36 of the second member 24 can be recessed in an area where the third member 42 will close over the aperture 34. The third member has an exterior or upper surface 52 and an interior or lower surface 54. Desirably, the exterior surface 52 of the third member 42 will be flush with the top wall 36 of the second member 24 when in a closed position. A double, ringlike shoulder 56 projects downward from the inner surface 54 of the third member 42 and crates an elliptical channel 58 therebetween. The elliptical channel 58 engages with an elliptical rim 60 formed about the periphery of the aperture 34 when the third member 42 is in its closed position and forms a moisture barrier. The dimensions of the shoulder 56 and the channel 58 can be adjusted such that a tight or interference fit is obtained. Such a tight or interference fit will secure the third member 42 to the second member 24 and insure a seal is formed. It should also be noted that downward pressure on the top wall 36 of the second member 24 will not destroy the moisture barrier for the third member 42 is designed to flex downward as well and remain engaged to the second member 24.

The third member 42 can also contain a locking mechanism, not shown but known to those skilled in the art, to secure the third member 42 in a closed position over the second entrance 32. One example of a locking mechanism can be a tab and latch located between the second member 24 and the interior or lower surface 54 of the third member 42. As the latch passes over the tab, it will lock the second and third members, 24 and 42 respectively, together.

The elliptical or oval shape of the third member 42 also serves another useful function in that it is sufficiently large to enables the user of the dispenser 10 to use the third member 42 to hold the dispenser 10 stationary. The third member 42 is capable of pivoting or rotating at least about 180 degrees from its closed position. Desirably, the third member 42 can pivot or rotate at least about 225 degrees from its closed position, and more desirably, at least about 270 degrees from its closed position. For example, the user could position his or her elbow, knee or other body part on the third member 42, when it is in an open position having pivoted about 180 degrees from its closed position, to hold the dispenser 10 stationary while removing one or more sheet-like articles 12. It should be mentioned that if the dispenser 10 is positioned on the edge of a table, the third member 42 can be opened from between about 225 degrees to about 270 degrees from its closed position and the user can position his or her hip or thigh against the third member 42 to hold the dispenser 10 stationary. In addition, when the third member 42 is opened about 180 degrees from its closed position, the consumer can place a diaper bag, a purse or any other heavy object on top of it to hold the dispenser stationary. This ability to use the third member 42 to hold the dispenser 10 stationary without using one's hands is very beneficial.

Referring to, FIGS. 1, 5, 7, 9 and 11, the dispenser 10 also possesses an easy opening mechanism that can be activated with only one hand. This one hand opening feature is obtained by forming a pair of spaced apart finger tabs 62 and 64 on the first member 22. The pair of finger tabs 62 and 64 are positioned along the second longitudinal edge 40 and project outward therefrom. In addition, a single finger tab 66 is formed on the second member 24. The finger tab 66 is also positioned along the second longitudinal edge 40 and project outward therefrom. The finger tab 66 is positioned between the pair of finger tabs 62 and 64 and can slightly overlap the finger tabs 62 and 64, if desired. It should be noted that alternatively, the pair of finger tabs 62 and 64 could be formed on the second member 24 and the single finger tab 66 could be formed on the first member 22, if desired. The finger tabs 62, 64 and 66 project outwardly away from the second longitudinal edge 40 by at least about 0.25 inches (about 0.6 cm) and provide an easy means for the user to open the first entrance 30 into the dispenser 10.

Still referring to FIG. 1, the first member 22 also has an outwardly projecting lip 68 situated between the pair of finger tabs 62 and 64. The lip 68 is designed to mate with a catch 70 formed on the lower surface of the finger tab 66. As downward pressure is applied to the upper surface of the second member 24, the catch 70 will move downward over the lip 68 and lock therewith. To unlock the dispenser 10 and open the first entrance 30, the user simply has to position his or her thumb on top of one of the outer finger tabs 62 or 64 and position his or her index finger below the middle finger tab 66. By pushing up with his or her index finger, the catch 70 will be released from the lip 68 and the second member 24 will pivot on the first hinge 26. A gentle nudge with the hand on the inside surface of the second member 24 will move it to the fully open position.

While the invention has been described in conjunction with several specific embodiments, it is to be understood that many alternatives, modifications and variations will be apparent to those skilled in the art in light of the aforegoing description. Accordingly, this invention is intended to embrace all such alternatives, modifications and variations that fall within the spirit and scope of the appended claims.

We claim:

1. A dispenser for dispensing articles from two locations comprising:

a) a first member;

b) a second member pivotally connected to said first member by a first hinge to form a first entrance into said dispenser, said first and second members each having a depth dimension to form a cavity when connected and closed, and said second member having a top wall with a second entrance formed therethrough;

c) a third member secured to said first member, said third member having a second hinge aligned along a common axis with said first hinge, and said third member pivoting on said second hinge to cover said second entrance; and wherein said dispenser has a generally rectangular configuration with a longitudinal axis, a transverse axis and a vertical axis, said dispenser having a first longitudinal edge spaced apart and oppositely aligned to a second longitudinal edge, and said first hinge and said second hinge are aligned along said first longitudinal edge;

wherein said first member, said second member, and said third member are integrally formed as a single entity.

2. The dispenser of claim 1 wherein said single entity is formed by injection molding.

3. The dispenser of claim 1 wherein said second entrance is an aperture comprising an ellipse with a major axis aligned parallel to said transverse axis.

4. The dispenser of claim 1 wherein said dispenser has height of about 1 inch.

5. The dispenser of claim 1 wherein said second and third members pivot on said first longitudinal edge and move away from said second longitudinal edge when opening said first and second entrances, respectively.

6. The dispenser of claim 1 wherein said dispenser has an inside width and said second entrance has a transverse dimension that is at least about 65% of said inside width.

7. A product comprising: a dispenser enclosing a plurality of folded sheet-like articles, said dispenser and said plurality of folded sheet-like articles comprising:

a) a first member;

b) a second member integrally formed with and pivotally connected to said first member by a first hinge to form a first entrance into said dispenser, said first and second members each having a depth dimension that when closed together form a cavity and retain said plurality of folded sheet-like articles between them, and said second member having a top wall with a second entrance formed therethrough;

c) a third member secured to said first member, said third member having a second hinge aligned along a common axis with said first hinge, and said third member pivoting on said second hinge to cover said second entrance; and wherein said dispenser has a generally rectangular configuration with a longitudinal axis, a transverse axis and a vertical axis, said dispenser having a first longitudinal edge spaced apart and oppositely aligned to a second longitudinal edge, and said first hinge and said second hinge are aligned along said first longitudinal edge;

wherein said first member, said second member, and said third member are integrally formed as a single entity.

8. The dispenser of claim 7 wherein said dispenser has a height ranging from between about 0.25 inches to about 3.5 inches.

9. The dispenser of claim 8 wherein said second entrance is an aperture comprising an ellipse with a major axis aligned parallel to said transverse axis of said dispenser.

10. The dispenser of claim 7 wherein each of said plurality of folded sheet-like articles has a width, and said second entrance has a maximum dimension which ranges from between about 60% to about 150% of the width of said plurality of folded sheet-like articles.

11. The dispenser of claim 7 wherein each of said plurality of folded sheet-like articles has a width, and said second entrance has a maximum dimension which ranges from between about 70% to about 100% of the width of said plurality of folded sheet-like articles.

12. The dispenser of claim 11 wherein each of said plurality of folded sheet-like articles has a width, and said second entrance has a maximum dimension which ranges from between about 75% to about 90% of the width of said plurality of folded sheet-like articles.

13. A product comprising: a dispenser enclosing a plurality of sheet-like articles each having a width, said dispenser and said plurality of sheet-like articles comprising:

a) a first member;

b) a second member pivotally connected to said first member by a first hinge to form a first entrance into said dispenser, said first and second members each having a depth dimension that when closed together form a cavity and retain said plurality of sheet-like articles between them, said second member having a top exterior wall with a second entrance formed therethrough, and said second entrance having a maximum dimension which ranges from between about 70% to about 100% of the width of said sheet-like articles;

c) a third member secured to said first member, said third member having a second hinge aligned along a common axis with said first hinge, and said third member pivoting on said second hinge to cover said second entrance; and wherein said dispenser has a generally rectangular configuration with a longitudinal axis, a transverse axis and a vertical axis, said dispenser having a first longitudinal edge spaced apart and oppositely aligned to a second longitudinal edge, and said first hinge and said second hinge are aligned along said first longitudinal edge;

wherein said first member, said second member, and said third member are integrally formed as a single entity.

14. The dispenser of claim 13 wherein said dispenser has a height of about 1 inch.

15. The dispenser of claim 13 wherein said second entrance is an aperture comprising an ellipse having a major axis aligned parallel to the transverse axis of said dispenser and said aperture having a surface area of at least about 20 $cm^2$.

16. The dispenser of claim 13 wherein said second entrance has a maximum dimension which ranges from between about 75% to about 95% of the width of said sheet-like articles.

17. The dispenser of claim 13 wherein said third member can pivot at least about 225 degrees from its closed position flush with a top wall of the second member wherein it covers said second entrance and be used to hold said dispenser stationary.

18. The dispenser of claim 17 wherein said third member can pivot at least about 270 degrees from its closed position flush with a top wall of the second member wherein it covers said second entrance and be used to hold said dispenser stationary.

* * * * *